US005145171A

United States Patent [19]

Head et al.

[11] Patent Number: 5,145,171

[45] Date of Patent: Sep. 8, 1992

[54] GRIPS FOR HANDLES

[75] Inventors: Robert W. Head, Melksham; James S. Aldridge, Devizes, both of England

[73] Assignee: Avon Industrial Polymers Limited, Melksham, England

[21] Appl. No.: 683,578

[22] Filed: Apr. 10, 1991

Related U.S. Application Data

[63] Continuation of Ser. No. 467,339, Jan. 19, 1990, abandoned, which is a continuation of Ser. No. 266,692, Nov. 3, 1988, abandoned.

[30] Foreign Application Priority Data

Nov. 4, 1987 [GB] United Kingdom ..... 8725836

[51] Int. Cl.[5] ..... A63B 59/00; A63B 53/14; A63B 49/00

[52] U.S. Cl. ..... 273/67 R; 273/67 DB; 273/75; 273/81 R; 40/915

[58] Field of Search ..... 273/81 R-81 B, 273/81.2-81.6, 162 R, 67 R, 73 J, 75, 162 F, 67 DB, 32 R-32 B; 74/551.9, 558.5; 81/489-492, 177.1, 177.4; 16/DIG. 12, 110.5; 40/317, 915; 30/86, 125; 24/625; 174/46

[56] References Cited

U.S. PATENT DOCUMENTS

| | | | |
|---|---|---|---|
| 733,126 | 7/1903 | Bellows | 81/177.1 |
| 1,317,691 | 10/1919 | Fields | 30/12 S |
| 1,658,447 | 2/1928 | Lantz | 273/81 A |
| 1,777,822 | 10/1930 | Barrett | 273/81 R |
| 1,831,255 | 11/1931 | Menzies | 273/81 R |
| 2,044,567 | 6/1936 | Daday | 273/81 R |
| 2,115,119 | 4/1938 | Park | 273/81 R |
| 2,757,002 | 7/1956 | Ryden | 273/67 R |
| 3,366,384 | 1/1968 | Lamkin et al. | 273/81 R |
| 3,645,008 | 2/1972 | Delsack | 273/75 |
| 4,690,407 | 9/1987 | Reisner | 273/81 A |

FOREIGN PATENT DOCUMENTS

| | | | |
|---|---|---|---|
| 3217788 | 11/1983 | Fed. Rep. of Germany | 273/81 R |
| 1356971 | 6/1974 | United Kingdom | 273/81 R |
| 1578372 | 11/1980 | United Kingdom | 81/177.4 |
| 2125299 | 3/1984 | United Kingdom | 273/81 R |
| 2186492 | 8/1987 | United Kingdom | 273/75 |

*Primary Examiner*—William H. Grieb
*Assistant Examiner*—Sebastiano Passaniti
*Attorney, Agent, or Firm*—Abelman Frayne & Schwab

[57] ABSTRACT

A handle grip comprises an end cap and an elastomeric sleeve. The end cap is retained in the sleeve by projecting legs having barbed enlargements which are to lie between the handle and engage in recesses in the internal surface of the sleeve. The end cap may comprise a separate cover. The sleeve may have axial channels in its inner surface for receiving the legs or barbed enlargements thereon during insertion of the end cap.

11 Claims, 2 Drawing Sheets

GRIPS FOR HANDLES

This application is a continuation, of application Ser. No. 467,339, filed Jan. 19, 1990, abandoned which is a continuation of application Ser. No. 266,692 filed Nov. 3, 1988, abandoned.

DISCLOSURE STATEMENT

DE-A-3217788 discloses a deformable end cap on the end of a wooden tubular sleeve. The end cap is deformed in situ so as to drive enlargements on its legs into the internal wall of the sleeve.

GB-A 1356971 discloses a handle grip in which the sleeve is of elastomeric material, the end cap having legs which (in its FIG. 6) fit between a handle and the sleeve.

In GB-A-2125299 the skirt of an end cap which encloses a balancing weight is shrunk onto the end of the handle and then covered by the turning back of a rubber sleeve.

FIELD OF THE INVENTION

This invention relates to grips for handles and particularly to grips for the handles of games implements such as tennis and squash racquets and golf clubs.

DESCRIPTION OF THE PRIOR ART

Handle grips comprising separate end caps and sleeves are known.

For example

DE-A-3217788 discloses a deformable end cap on the end of a wooden tubular sleeve. The end cap is deformed in situ so as to drive enlargements on its legs into the internal wall of the sleeve.

GB-A 1356971 discloses a handle grip in which the sleeve is of elastomeric material, the end cap having legs which (in its FIG. 6) fit between a handle and the sleeve.

In GB-A-2125299 the skirt of an end cap which encloses a balancing weight is shrunk onto the end of the handle and then covered by the turning back of a rubber sleeve.

SUMMARY OF THE INVENTION

The present invention provides a handle grip which is more convenient and effective in use than those of the prior art.

This is done by providing a handle grip in which the end cap has a projection to fit between a handle and the sleeve with enlargements thereon to fit into recesses in the sleeve, thereby to retain the end cap in the sleeve. It is preferred that the projecting part is a plurality of separate legs, in which case the sleeve includes on its inner surface adjacent the end engaging the end cap recesses for engaging said legs. Additionally the sleeve may have on its inner surface axial channels for engaging enlargements on the projecting part.

Retention of the cap on the handle may be assisted or further assisted by an adhesive surface on the handle.

Since the parts of the grip are separate selections may be made of different grades or character or colour of sleeve and cap, for example to denote different qualities or nature of the implement, or to provide a "personalised" implement for an individual.

It will be specifically explained with reference to grips for golf clubs, known as golf grips.

DESCRIPTION OF PREFERRED EMBODIMENTS OF THE INVENTION

Figure 1:
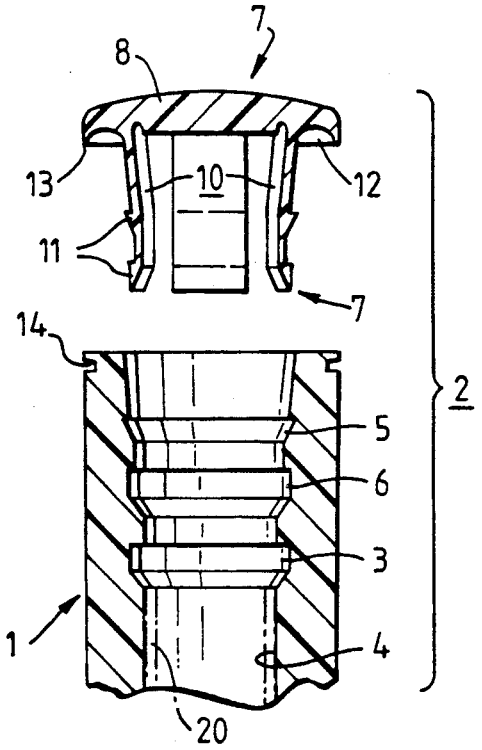
FIG. 1 shows the parts of a first embodiment of the invention in diametrical section.
Figure 2:
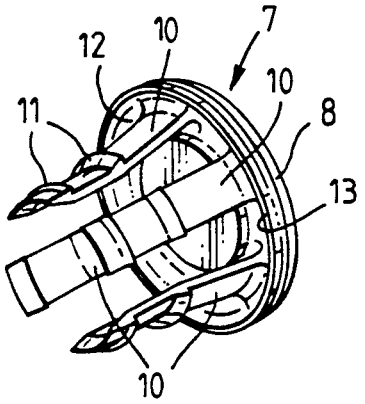
FIG. 2 is a perspective exploded view of the end cap of the grip of FIG. 1.
Figure 3:
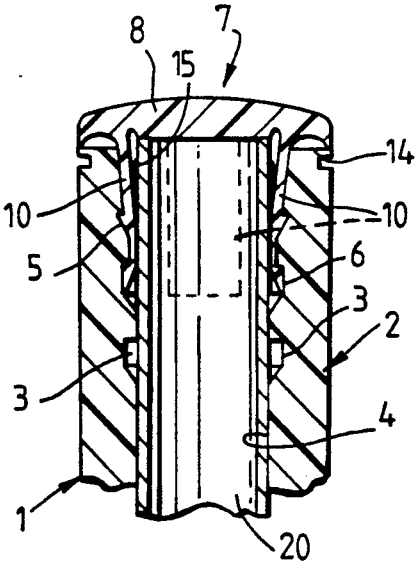
FIG. 3 is a diametrical section of the grip of FIG. 1 assembled on a handle of a golf club.

An open-ended sleeve 1 of elastomeric material for a golf grip 2 is moulded in the usual way with a tapered core pin. On its inner surface it has known annular and/or axial recesses 3, 4 which affect its "feel" and softness when gripped. Additional annular recesses 5, 6 are moulded near to the end of the sleeve which is to be at the end of a handle 20 (FIG. 3) on which it is fitted. The sleeve 1 provides a first preformed internal surface for gripping engagement with the handle 20, and provides a second pre-formed internal surface for the retention of an end cap 7.

The end cap 7 is a separate part of the grip. It has a top disc 8 to cover over the end of the handle 20 and also over the end of the sleeve 1. The cap also has a projecting part 9 consisting of four legs 10 (although other numbers, e.g. six legs, may be employed) or the part may be a skirt. Rotation of the end cap 7 may be prevented by providing, analogous to the embodiment of FIG. 8, axial channels in the sleeve 1 at the end of the sleeve adjacent the end cap, the channels being dimensioned to receive the legs 10 of the cap or enlargements on the legs. The legs 10 have on them enlargements 11. These are to engage respectively in annular recesses 5, 6. The enlargements 11 have one slanted and one flat face so as to act as if barbed; engagement of the flat faces against the also flat upper faces of the recesses 5, 6 acts to prevent withdrawal of the cap 7 once engaged.

The complenentary engagement of the enlargements and the recesses relieves the sleeve 1 from radially outwards forces when the cap 7 is properly inserted into the sleeve 1 and secured therein by the enlargements 11, thus relieving the sleeve from outwards forces that could otherwise cause bulging of the sleeve.

The portion of the disc overhanging the legs 10 is undercut at 12 so that there is a downwardly projecting rim 13. When the cap is fully engaged this rim will press down on a marginal part of the end of the sleeve 1, so that there is a positive engagement between them; if desired, distortion of this part of the sleeve can be assisted by a small groove moulded in the outer surface of the sleeve. The gap 14 created between the rim 13 and the sleeve 1 allows venting of the air trapped in the sleeve when the assembled grip is seated on the handle, thus removing the necessity for a hole to be incorporated into the disc 8 for this purpose. In an alternative embodiment the rim 13 extends further downwardly to form an annular lip which loosely engages a corresponding portion of reduced radius at the top of the sleeve, so as to still permit air venting.

When assembling the grip, the end cap is fitted by simply pressing it into the sleeve. The assembled grip is then seated on the handle 20.

Retention of the grip may be assisted by the presence of a double-sided adhesive tape 15 on the handle.

Figure 4:
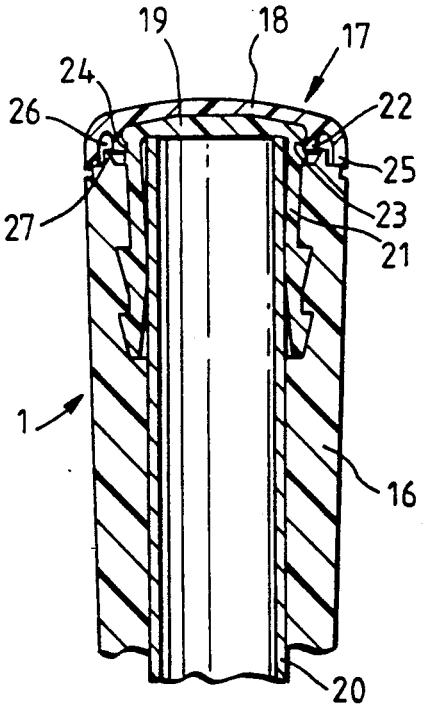
FIG. 4 shows, in diametrical section, a second embodiment of the invention assembled on a handle of a golf club.
Figure 5:
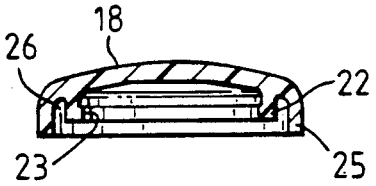
FIG. 5 shows a cover for the end cap in diametrical section.

In FIG. 4 there is shown a grip 16 assembled on a handle 20. In this embodiment there is a separate, disc-like, cover 18 which overlies an end body 19 and projections 21 of the cap 17. The cover 18 as shown separately in FIG. 5, has an inner mini-skirt 22 spaced inwardly from the periphery of the cover with an inwardly facing annular projection 23 on the inner mini-skirt 22 which engages in an annular recess 24 in the end body 19 thereby to retain the cover on the end body 19 by a snap fit.

The cover 18 also has an outer mini-skirt 25 around its periphery, the inner and outer mini-skirts 22, 25 defining therebetween a circular channel 26. A circular projection 27 from the top annular surface of the sleeve 1 lies in the circular channel 26 of the end body 19, thereby to provide a seal against the ingress of e.g. water and dirt.

Various types of end body adapted to receive a cover 18 are shown in FIGS. 6A to 6E. Obviously this provision of a separate cover increases the flexibility with which the end cap may be used as a denominator of origin, quality, type etc.

Figure 6A:
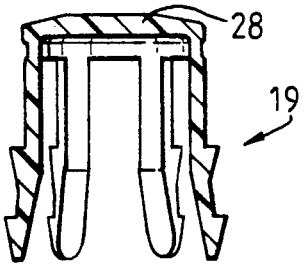
FIGS. 6A to 6E show various types of end cap, all in diametrical section.
Figure 6B:
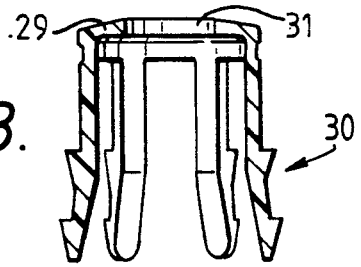

In FIG. 6A the end body 19 is as described above, having a complete top disc 28. In FIG. 6B the top disc 29 of the end body 30 has a coaxial circular aperture 31 in it.

Figure 6C:
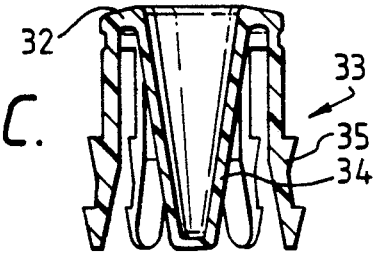

In FIG. 6C the central region of the top disc 32 of the end body 33 is formed into a frusto-conical projection 34 projecting in the direction of the extension of the legs 35 which projection 34 serves to guide the end body 33 into a tubular handle when the grip is assembled thereon. This projection may of course be cylindrical.

Figure 6D:
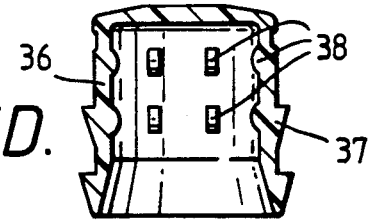

In FIG. 6D the legs of the above described end caps 7,17 are replaced with a continuous skirt 36. Barbed enlargements 37 are provided on the outer surface of the skirt 36 to engage in the recesses in the sleeve. In addition, projections 38 are provided on the internal surface of the skirt 36. The projections 38 serve to assist in securing the end cap to the shaft 20. The end cap can fit over a range of shaft diameters by varying the size of the projections in manufacture.

Figure 6E:
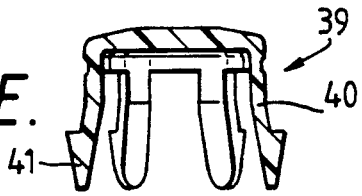

In FIG. 6E, the end body 39 has legs 40 as described above. A single barbed enlargement 41 is present on each leg 40.

Figure 7:
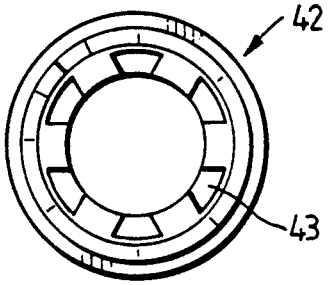
FIG. 7 is a plan view of a modified sleeve.
Figure 8:
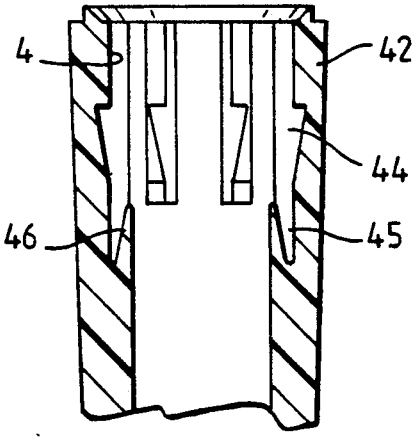
FIG. 8 shows a diametrical section of the sleeve of FIG. 7.

FIGS. 7 and 8 show a plan view of an alternative sleeve 42 which is effective in preventing rotation of th end cap in the sleeve. It has discrete axial channels 43 for receiving each leg of the end cap, or else the barbed enlargements on each leg. Recesses 44 in each channel 43 are provided with which the barbed enlargements on the legs of the end cap engage. These may have parallel or radial walls, or may as shown be of dovetail-section. In this embodiment, the recesses 43 have a lower part 45 defined by a lip 46 on the internal surface of the sleeve 42, into which, when fitted, is located the extreme end portion of the legs or skirt.

An advantage of this method of construction of grip is that if necessary the end cap can be removed from the grip prior to placing on the shaft of a golf club, and the sleeve initially seated alone. This enables weights for balancing the club to be lodged between the sleeve and the shaft much more conveniently than is the case when the sleeve and end cap are integral.

What we claim is:

1. A handle assembly for a sporting games implement comprising in combination: a hollow rigid handle having a longitudinal axis and an end portion;

a handle grip, said handle grip comprising a pre-formed open ended sleeve of elastomeric material having an exterior surface and a first pre-formed internal surface for gripping engagement with said rigid handle, and having a second pre-formed internal surface at one axial end thereof and in annular coplanar relation with said first internal surface for engagement with an end cap for said handle, said second pre-formed internal surface having pre-formed recesses extending outwardly away from the annular plane containing said second internal surface toward said exterior surface, said sleeve being adapted to fit tightly around said end portion of said handle so as to be retained thereon; and said end cap comprising an axially extending part to be entrapped between said sleeve and said handle, and having radially outwardly extending enlargements of complementary configuration to the configuration of said pre-formed recesses in said sleeve on said axially extending part of said end cap, said enlargements projecting outwardly and away from said handle when said end cap is assembled on said handle end;

wherein, in the assembled condition of said handle and said end cap, said enlargements engage within said recesses, thereby to retain said end cap against axial displacement within said sleeve without imposing forces causing radially outward bulging of the exterior surface of said handle grip in the proximity of said enlargements on said axially extending part of said end cap.

2. The combination as claimed in claim 1, wherein a sleeve has an annular end surface underlying said cover, to removably fit over said end portion to form an extreme end of said handle there being an annular projection provided on said end surface which sealingly engages a part of said cover.

3. The combination as claimed in claim 1, wherein said projecting part comprises a plurality of separate legs, and said sleeve includes, on said second internal surface, a plurality of axially extending channels for respectively receiving said legs.

4. The combination as claimed in claim 1, wherein said projecting part is a peripherally continuous skirt and said sleeve includes, on said second internal surface, axially extending channels for receiving discrete ones of said enlargements on said skirt.

5. The combination as claimed in claim 1, wherein said end cap includes an internally projecting hollow part for extending within said handle.

6. The combination as claimed in claim 1 wherein said implement is selected from a racquet and a golf club.

7. The combination according to claim 1 wherein said end cap comprises a body with two generally parallel annular faces, said projecting part projecting from one of said faces and a separate cover engageable with said body to overlay the other one of said faces.

8. The combination according to claim 1, wherein said second internal surface includes axially-directed channels providing a radial surface at an end thereof adjacent said axial end of said handle grip, and said enlargements on said axially extending part having complementary radially extending surfaces for face engagement with said radial surfaces of said axially-directed channels, to prevent removal of said end cap from said handle grip subsequent to the assembly of said end cap onto said handle grip.

9. A method of making an assembly of a games implement handle and an end cap therefor according to claim 1, the method including providing said rigid games implement handle having said end portion;

fitting around said end portion said pre-formed elastomeric sleeve to form said grip thereon, said sleeve having said exterior and said first and second inner surfaces the internal surfaces being undersized for the handle so as to be expanded thereby, said sleeve further having, in its second internal surface and adapted to overlay the rigid handle, at least one of said outwardly extending recesses;

providing also said end cap for said assembly, the end cap including a portion for bridging over one end of the rigid handle and an axially extending part for projecting along said handle, said projecting part having at least one of said enlargements extending radially outwardly thereon and adapted for complementary engagement with said at least one recess; and assembling said end cap over said end of said handle with said projecting part between said handle and said sleeve to be retained around said handle by the resilience of said sleeve, with said at least one of said enlargements making engagement with said as least one recess in the elastomeric sleeve, whereby said exterior surface of said elastomeric sleeve, outwardly of said enlargements and recesses, is not disturbed by said engagement.

10. The method as claimed in claim 9, wherein said projection comprises discrete legs and said sleeve includes corresponding axially-directed recesses for complementing said legs, said method including positioning said cap with said legs in said axial recess.

11. The combination as claimed in claim 1, wherein the end cap comprises an end body having said projecting part and a separate cover to fit removably over said end portion to form an extreme end of the handle, said separate cover being selected from a plurality of said separate covers, each capable of said removable fit, and bearing, respectively, different indicators regarding the nature of the implement.

* * * * *